US008870013B2

(12) United States Patent
Alvares et al.

(10) Patent No.: US 8,870,013 B2
(45) Date of Patent: Oct. 28, 2014

(54) CLOSURE DEVICE FOR METALLIC CONTAINERS

(75) Inventors: Antonio Carlos Texeira Alvares, Sao Paulo (BR); Silverio Candido Da Cunha, Lajeado (BR)

(73) Assignee: Brasilata S.A. Embalagens Metalicas, Sao Paolo (BR)

( * ) Notice: Subject to any disclaimer, the term of this patent is extended or adjusted under 35 U.S.C. 154(b) by 0 days.

(21) Appl. No.: 13/991,445

(22) PCT Filed: Dec. 7, 2011

(86) PCT No.: PCT/BR2011/000464

§ 371 (c)(1),
(2), (4) Date: Aug. 30, 2013

(87) PCT Pub. No.: WO2012/075556

PCT Pub. Date: Jun. 14, 2012

(65) Prior Publication Data

US 2013/0334240 A1 Dec. 19, 2013

(30) Foreign Application Priority Data

Dec. 8, 2010 (BR) ..... 1005786

(51) Int. Cl.

| | |
|---|---|
| ***B65D 45/32*** | (2006.01) |
| ***B65D 43/02*** | (2006.01) |
| ***B65D 45/30*** | (2006.01) |
| ***B65D 55/08*** | (2006.01) |

(52) U.S. Cl.

CPC ..... *B65D 43/02* (2013.01); *B65D 45/32* (2013.01); *B65D 43/0249* (2013.01); *B65D 43/0256* (2013.01); *B65D 45/30* (2013.01); *B65D 55/0881* (2013.01); *B65D 2543/00027* (2013.01); *B65D 2543/00092* (2013.01); *B65D 2543/0024* (2013.01); *B65D 2543/00277* (2013.01); *B65D 2543/00435* (2013.01); *B65D 2543/00564* (2013.01); *B65D 2543/00657* (2013.01); *B65D 2543/00972* (2013.01)

USPC ..... 220/319; 220/780; 220/324; 215/274; 292/299; 292/256.6

(58) Field of Classification Search

CPC .. B65D 50/064; B65D 50/62; B65D 41/0442; B65D 50/065; B65D 2543/00972; B65D 2543/00962; B65D 2543/00953; B65D 45/305; B65D 41/08

USPC ..... 220/315, 319, 212, 780, 782, 324, 796, 220/669; 292/299, 307 R; 215/273, 274

See application file for complete search history.

(56) References Cited

U.S. PATENT DOCUMENTS 4,434,910 A * 3/1984 Groult ..... 220/804
4,728,003 A * 3/1988 Davey ..... 220/319

(Continued)

FOREIGN PATENT DOCUMENTS

| | | |
|---|---|---|
| BR | PI0901343-1 | 1/2011 |
| FR | 2 440 322 A1 | 5/1980 |
| FR | 2 521 530 A1 | 8/1983 |

*Primary Examiner* — Robert J Hicks
*Assistant Examiner* — Kareen Rush
(74) *Attorney, Agent, or Firm* — Harrington & Smith

(57) ABSTRACT

The closure device includes: a retention ring seated around the container and axially locked between a finishing cord and a peripheral rib, which are externally incorporated to an upper region of the tubular body of the container; and a locking ring which is seated and affixed around an end cord of the lid and incorporating an outer skirt surrounding the end cord and the finishing cord and being elastically deformable, from a locked position against upward displacement at the locking ring, to a position unlocked from the latter. The device may further include a suspension handle coupled to the retention ring, and a seal means cooperating with both the retention ring and the locking ring to make evident a first opening of the container.

10 Claims, 5 Drawing Sheets

(56) References Cited

U.S. PATENT DOCUMENTS 5,421,473 A * 6/1995 McCrossen ..... 220/319
7,004,341 B2 * 2/2006 Shenkar et al. ..... 215/256
7,617,946 B2 * 11/2009 Loerop et al. ..... 220/319
2010/0127003 A1 * 5/2010 Alvares et al. ..... 220/669

* cited by examiner

CLOSURE DEVICE FOR METALLIC CONTAINERS

FIELD OF THE INVENTION

The present invention refers to a closure device to be applied in metallic containers, such as pails, comprising a tubular body having a peripheral side wall which has a lower end portion to which is attached a bottom wall, and an upper end portion surrounding an opening, inside which is fitted and axially locked an also metallic lid with a peripheral upper skirt provided with at least one sealing element which cooperates with an upper end portion of the peripheral side wall of the tubular body of the container, to guarantee the tightness of the closure by the lid.

PRIOR ART

There are well known from the prior art the closure arrangements of the type mentioned above and which present one of the parts defined by the upper end portion of the tubular body of the container, or by the peripheral upper skirt of the lid provided with at least one circumferential rib which is fitted and axially retained into a respective and confronting circumferential groove provided on the other of said parts, in order to guarantee a reliable axial retention of the lid when fitted into the upper opening of the tubular body of the container.

These closure arrangements are provided with at least one annular sealing element, usually an elastic sealing ring or a synthetic resin gasket, which is carried by the peripheral upper skirt of the lid, in order to be seated against a confronting portion of the peripheral side wall of the tubular body of the container. Some of these tight closure arrangements are associated with a suspension handle for the container.

One known constructive solution for providing a secure axial locking of the lid to the container, a reliable sealing between the lid and the container, and a suspension handle for the container, either in the closed or open position of the lid, is suggested in the patent document PI 0901343-1 of the same assignee. Although said prior solution provides a secure axial retention and a tight closure of the lid to the body of the container, as well as a reliable suspension handle, there are some limitations, as mentioned below, which drive the search for improvements of the presently known devices for providing the safe and tight axial retention of the lid to the container body, and further providing, preferably but not mandatorily, a reliable suspension handle.

Referring to this prior solution, it can be observed that the axial locking of the lid, when fitted into the interior of the upper opening of the body of the container, requires a mechanical interference, through the elastic deformation of the related portions, between a rib externally incorporated on the peripheral upper skirt of the lid and a corresponding groove internally provided on the side wall of the body of the container, that is, it requires the frictional contact of the metallic material of the lid with the metallic material of the container.

The interference fitting between the lid and the tubular body of the container tends to cause wear of the varnish film that protects the metal sheet of the lid and of the body of the container, allowing, after successive opening and closing operations of the lid, to occur oxidation in these regions of metal-metal contact, which oxidation can be more or less intense depending on the aggressiveness of the product to be filled and on the fact of these regions being in direct contact or not with the product contained within the container. The metal sheet deterioration may contaminate the stored product.

This known closure arrangement is not recommended for metal sheet containers internally protected with varnish and destined to be filled with products aggressive to said metal sheet.

The above mentioned metal-metal contact problem may have its consequences minimized by the solution suggested in the patent document PI0801964-9 of the same assignee. In this prior solution, the peripheral upper skirt of the lid has an outer circumferential groove carrying an elastic sealing ring and provided in a position lower than any region of frictional mechanical interference between the metal sheets of the lid and the tubular body of the container. However, this prior solution does not avoid the metal-metal contact and the inconveniences thereof, and also requires a more complex and costly conformation of the upper portion of the peripheral side wall of the tubular body and of the peripheral upper skirt of the lid, in order to provide the ribs and grooves, for mutual fitting, with undesirably reduced manufacturing tolerances.

In some prior constructive solutions, which make use of the locking of the lid through a metal-metal mechanical interference, such as described in the patent document PI0901343-1, the sealing upon closing the lid is assured by providing a gasket defined by a film of resin such as plastisol, housed into a circumferential groove of the upper skirt of the lid, or inside an upper curl of the latter, in order to be seated against the side wall of the tubular body of the container, or onto a finishing cord provided on the upper edge of the tubular body of the container, upon closing the lid.

Although these gaskets usually assure an adequate tightness between the lid and the tubular body of the container, they have the drawback of requiring the provision of specific housings in the region of the upper skirt of the lid, as well as more precise operations of metal sheet conformation and of application of the resin for forming the gasket. Thus, there are required more complex equipment, increased quality control for reduced dimensional tolerances, and also an additional operation at the production lines, all adding cost to the final product.

Regarding the handling of the container, the solution described in the patent document PI0901343-1 provides a suspension handle having the opposite ends thereof pivotably coupled, or incorporated by an elastically deformable portion, in diametric opposite regions of a retention ring, which is simultaneously seated onto the peripheral curl of the lid and under the finishing cord of the upper end of the container. Although this suspension handle is adequate to the suspension and manual transportation of the container, it can only be used when the container is closed by the lid. Thus, the suspension handle has the ends thereof mounted to a retention ring which is coupled to the lid, being, therefore, uncoupled from the container when the lid is removed. Therefore, this prior solution has an undesirable limitation for the use of the suspension handle.

SUMMARY OF THE INVENTION

Due to the inconveniences and limitations of the known solutions, it is an object of the present invention to provide a closure device for metallic containers of the type mentioned above, having a relatively simple and compact construction and which is able to provide the secure and tight closing of a metal sheet container by a removable lid also made of metal sheet, assuring a high level of tightness and avoiding the drawbacks of the metal-metal contact.

It is a further object of the invention to provide a closure device, such as mentioned above, which allows incorporating a suspension handle, which remains coupled to the tubular body of the container whether closed by the lid or open, without the latter.

It is also a further object of the invention to provide a closure device, as mentioned above, which allows a safety seal to be incorporated, such seal being able to show evidence of the first opening of the lid.

As already mentioned, the subject device is applied to metallic containers comprising: a tubular body having an upper end portion incorporating an outer and upper finishing cord, and an outer and lower peripheral rib; and a lid including a peripheral upper skirt to be fitted inside said upper end portion and externally incorporating an end cord.

According to the invention, the device comprises: a retention ring seated around the tubular body and axially locked between the finishing cord and the peripheral rib; a locking ring having an upper portion which is seated on the end cord of the lid and radially seated against the inside of the peripheral upper skirt of the lid, and an outer skirt, radially and externally seated against said end cord and finishing cord, and incorporating an inner circumferential rib which surrounds, inferiorly, said end cord and which is seated on the finishing cord, the outer skirt being elastically deformable, from a locked position on the retention ring against upward displacement, to a position unlocked from said retention ring.

The present device may comprise a suspension handle having the ends thereof articulated or incorporated at opposite regions of the retention ring and also a sealing means, which is affixed, in a breakable manner, to at least one of the parts of retention ring and of outer skirt, and cooperating with the other part to prevent the elastic deformation of the outer skirt until the seal is broken.

BRIEF DESCRIPTION OF THE DRAWINGS

The invention will be described below, with reference to the enclosed drawings, given by way of example of the possible embodiments of the invention and in which.

DETAILED DESCRIPTION OF THE INVENTION

Figure 1:
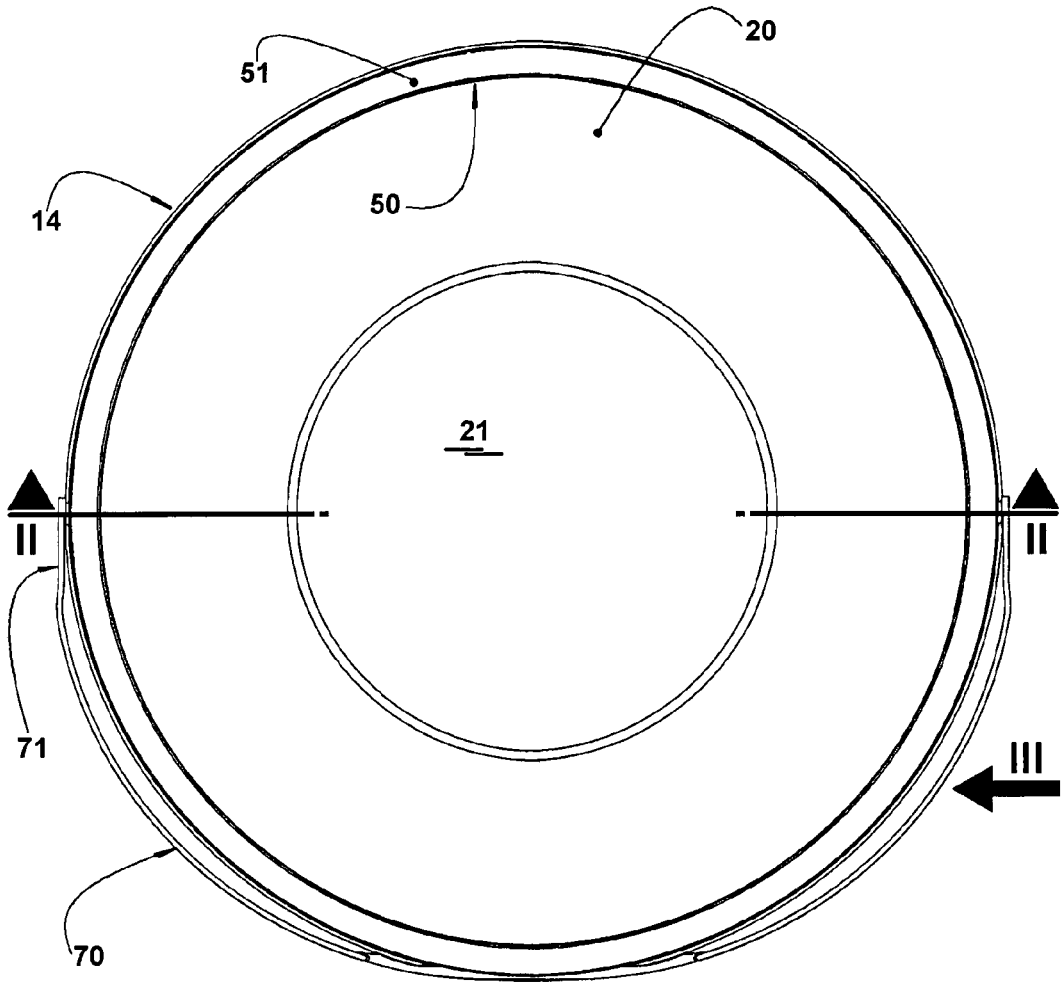
FIG. 1 represents a top plan view of the tubular body of a metallic container, closed by an upper lid and provided with the present closure device and with the suspension device with the suspension handle being in the inoperative lowered position.

The present closure device is applied to a container formed in metal sheet, usually tinplate and comprising a tubular body 10 of any polygonal cross section, usually circular and having an upper end portion 11, inside which is removably fitted and retained a lid 20, also formed in metal sheet.

Although not illustrated herein in detail, it should be understood that the container has the tubular body 10 thereof inferiorly closed by a bottom wall 12 of any adequate construction and which may be affixed to a lower end portion of the tubular body 10 by double seaming or by any other known method, it being understood that this constructive aspect has no influence over the characteristics of the device object of the present invention.

The upper end portion 11 of the tubular body 10 has a peripheral edge 11*a* externally incorporating a finishing cord 13. In the illustrated embodiment, the finishing cord 13 is obtained by bending the peripheral edge 11*a* outwardly, downwardly, inwardly and upwardly, in order to present a tubular or partially tubular cross-section. However, the finishing cord 13 may present different cross-sections, as long as it defines an outer peripheral step on the region of the peripheral edge 11*a* of the upper end portion 11 of the tubular body 10.

As illustrated, the upper end portion 11 of the tubular body 10 further incorporates, preferably by deformation of its metal sheet and on its lower portion, a peripheral rib 14, externally and axially spaced downwards in relation to the finishing cord 13 and projecting outwardly from the tubular body 10 by a radial extension greater than that of the finishing cord 13.

Figure 2:
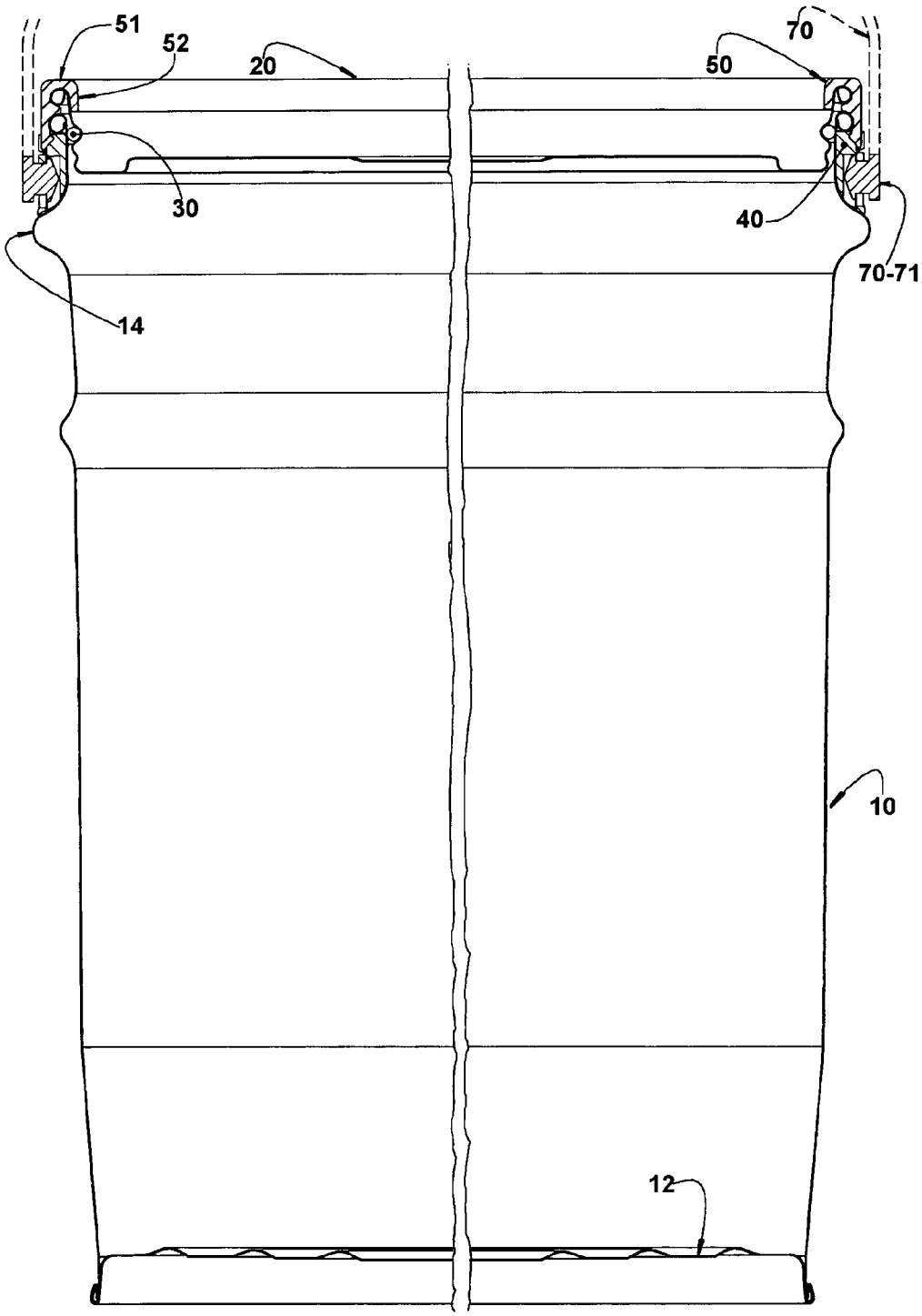
FIG. 2 represents a cross sectional view of the container, said section taken according to line II-II in FIG. 1 and further partially illustrating, in phantom lines, the suspension handle in the elevated operative condition.
Figure 3:
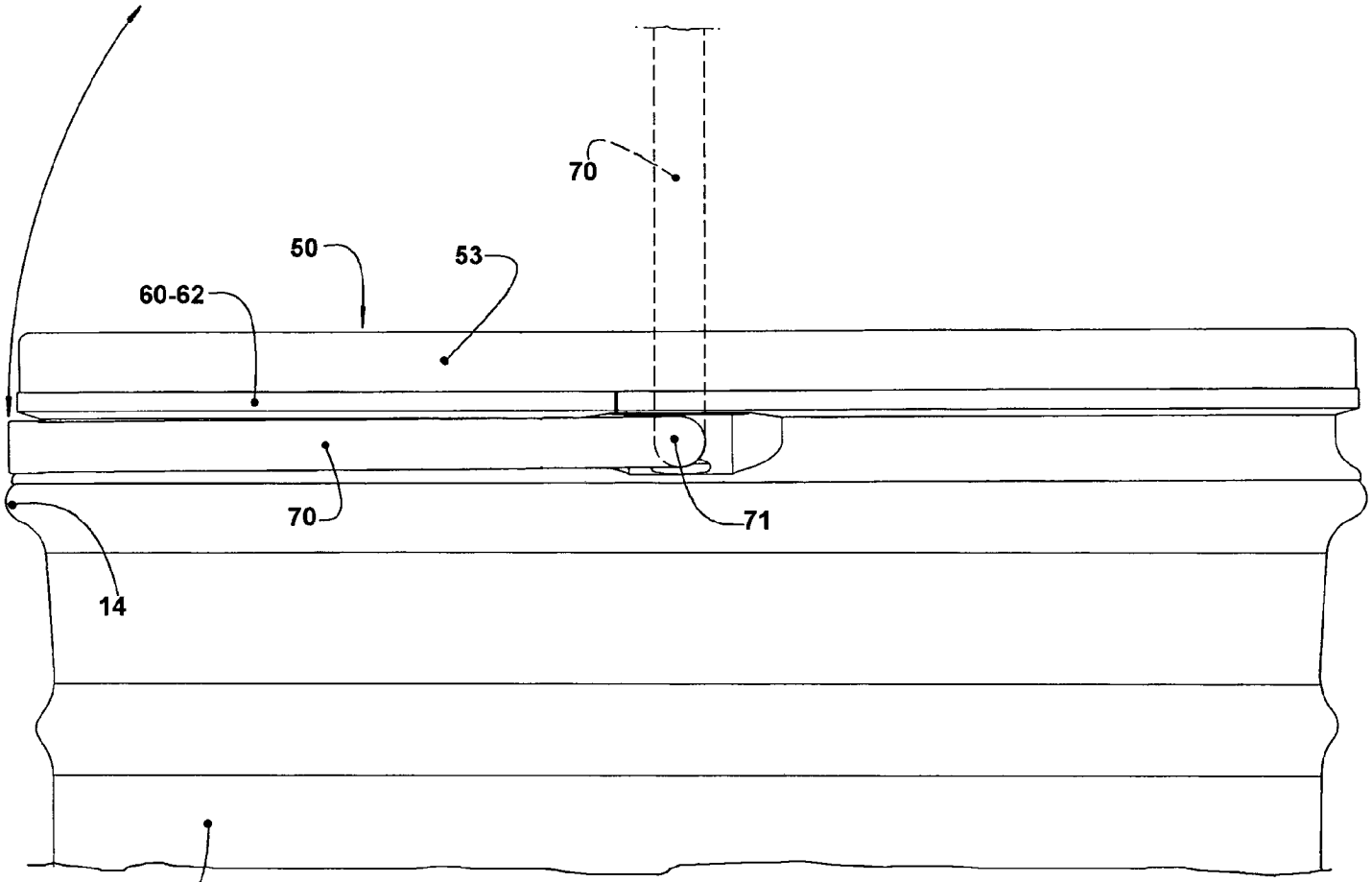
FIG. 3 represents an enlarged lateral and partially cut view of the container of FIG. 1, when observed in the direction of arrow III of said figure, the suspension handle being partially illustrated in phantom lines in the elevated operative condition.
Figure 4:
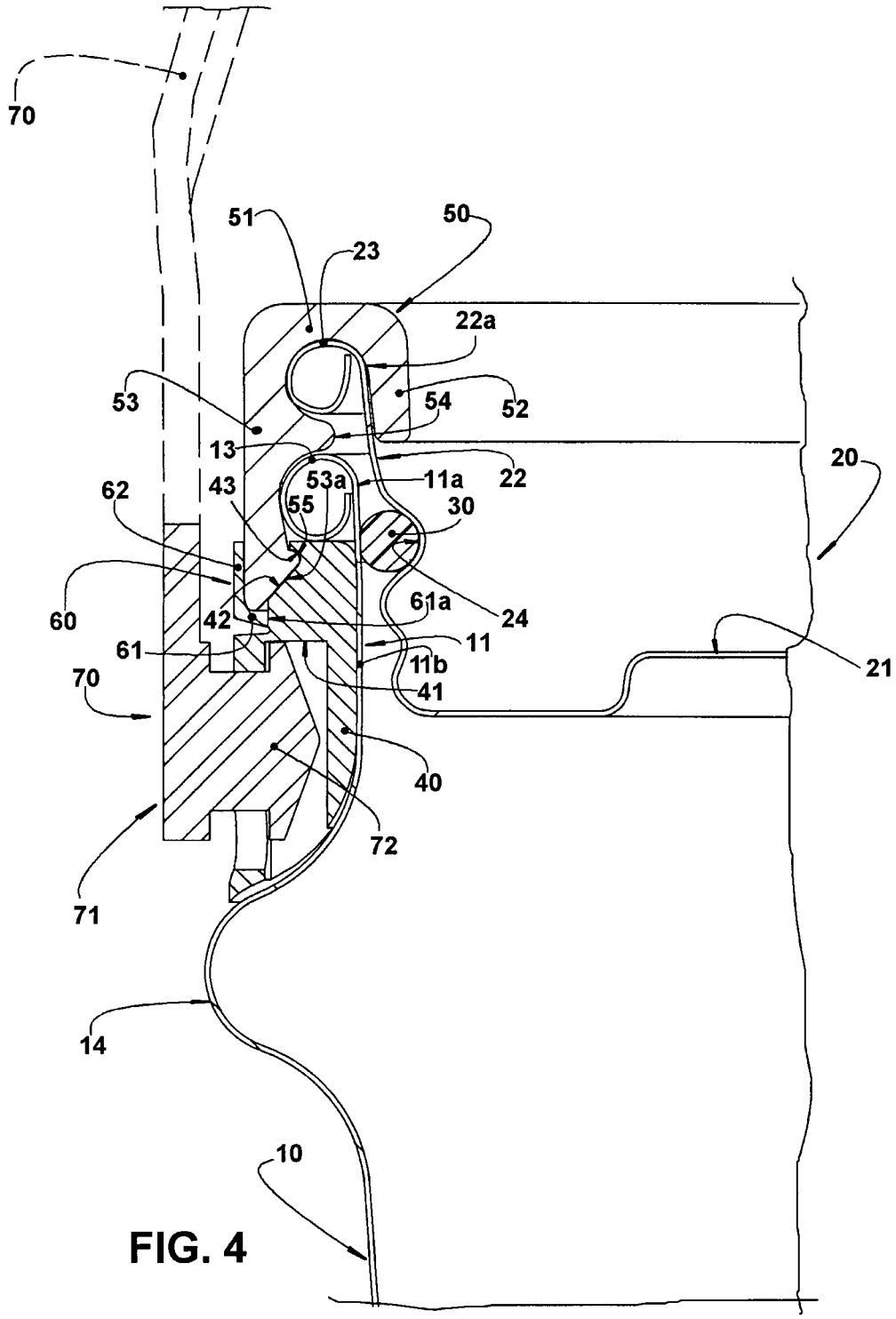
FIG. 4 represents an enlarged detail view of part of the container shown in FIG. 2, illustrating the assembly of said device to the tubular body, to the finishing cord of the latter and to the curl of the lid, prior to the first opening of the container and having the suspension handle also represented, partially and in dashed lines, in the elevated operative condition.
Figure 5:
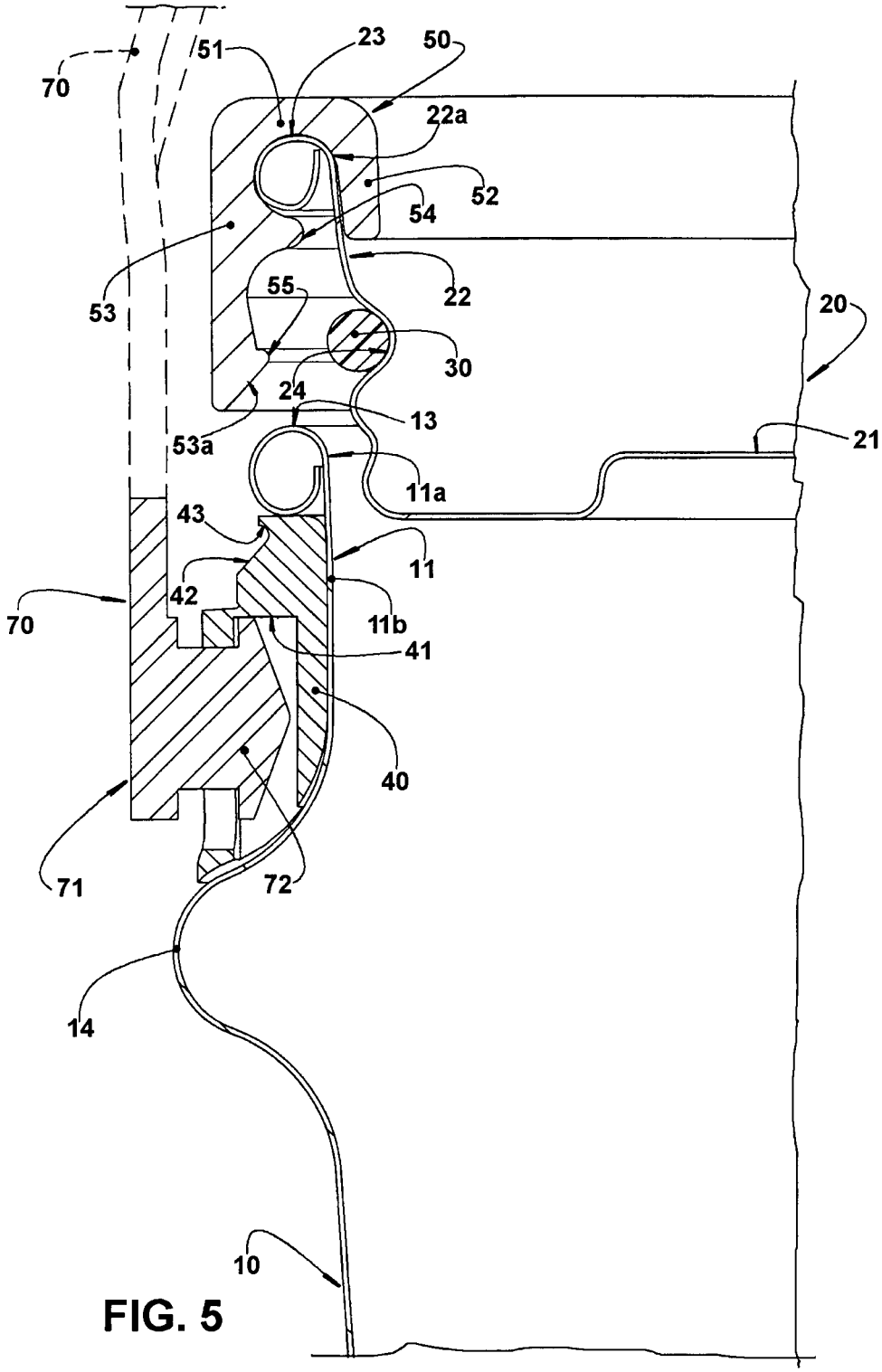
FIG. 5 represents a view similar to that of FIG. 4, illustrating the lid being exploded in relation to the tubular body of the container and having the safety seal removed and not illustrated.

The lid 20 comprises a median panel 21 and a peripheral upper skirt 22, which is configured to be seated with some radial spacing when the lid 20 is closed inside the upper end portion 11 of the tubular body 10, as illustrated in FIGS. 1 to 4 and described below.

The peripheral upper skirt 22 of lid 20 externally incorporates an end cord 23. In the illustrated embodiment, the end cord 23 is shaped as a tubular or approximately tubular curl, obtained by bending the end edge 22*a* of the peripheral upper skirt 22 of the lid 20 outwardly, downwardly, inwardly an upwardly, in order to define a preferably tubular cross section, externally adjacent to the peripheral upper skirt 22. According to the preferred illustrated embodiment, the upper end portion 11 of the tubular body 10 is defined by a cylindrical internal surface 11*b*, and the peripheral upper skirt 22 of the lid 20 is provided with a circumferential groove 24, facing outwards and housing an elastic sealing ring 30, to be pressed against the cylindrical internal surface 11*b* of the tubular body 10, when the tubular body 10 is closed by the lid 20.

With this construction, the peripheral upper skirt 22 of the lid 20 is kept radially spaced in relation to the cylindrical internal surface 11*b* of the tubular body 10, thus preventing metal-metal contact between the lid 20 and the tubular body 10.

According to the invention, the closure device comprises a retention ring 40, usually of plastic material, to be seated around the tubular body 10, in order to surround the upper end portion 11 thereof, being superiorly seated under the finishing cord 13 and inferiorly seated onto the peripheral rib 14, thus remaining axially locked between the finishing cord 13 and the peripheral rib 14 of the upper end portion 11 of the tubular body 10.

The closure device further comprises a locking ring 50, usually built in plastic material and presenting an upper portion 51 of annular shape, which is seated onto the end cord 23 of the lid 20 and which incorporates in a single piece, an inner skirt 52 radially seated against the inside of the peripheral upper skirt 22 of the lid 20, and an outer skirt 53, radially and externally seated against the end cord 23 of the lid 20, and against the finishing cord 13 of the tubular body 10, upon closure of the lid.

The locking ring 50 further incorporates an inner circumferential groove 54, disposed so as to simultaneously surround, inferiorly, said end cord 23 of the lid 20, and to seat onto the finishing cord 13 of the tubular body 10, when the lid 20 is closed.

With the construction above, the locking ring 50 remains constantly and solidly affixed to the lid 20, having the inner circumferential rib 54 thereof acting under the end cord 23 and further as a limiting stop for the fitting of the lid 20 in the tubular body 10, and further preventing the metal-metal contact between the end cord 23 and the finishing cord 13.

As illustrated in the drawings, the outer contour of the locking ring 50 is preferably contained inside the axial projection of the outer contour of the peripheral rib 14 of the tubular body 10, so as to minimize the possibility of outward radial displacement of the outer skirt 53 by means of involuntary impact against any obstacles, thus preventing undesirable opening of the lid 20.

According to the invention, the outer skirt 53 of the locking ring 50 is elastically deformable outwards, from a locked position against upwards displacement in the retention ring 40, to an unlocked position in relation to the latter. In the locked position of the outer skirt 53 of the locking ring 50, the latter and the lid 20 affixed thereto cannot be displaced outwards from the tubular body 10. On the other hand, when the outer skirt 53 is deformed elastically outwards, it is unlocked from the retention ring 40, allowing the locking ring 50 and the lid 20 to be jointly displaced upwardly, out of the tubular body 10.

According to the illustrated embodiment, the retention ring 40 is externally provided with a circumferential recess 42 defining therein an upper step 43, and the outer skirt 53 of the locking ring 50 is provided with a lower end face 53*a*, inclined upwardly and radially inwardly, and with at least one inner tooth 55, adjacent to the lower end face 53*a* and to be fitted and upwardly locked under the upper step 43 of the retention ring 40, retaining the locking ring 50 and the lid 20 fixed thereto against upward axial displacement, out of the closing position of the container.

Although the inner tooth 55 is illustrated as an internal and continuous circumferential projection of the outer skirt 53, it should be understood that there can be provided multiple teeth circumferentially aligned and spaced from each other.

Thus, the lid 20 is securely and axially locked inside the upper end portion 11 of the tubular body 10, by the fitting of the locking ring 50 in the retention ring 40, without causing any metal-metal contact between the lid 20 and the tubular body 10.

In the preferred embodiment illustrated in the drawings, the upper step 43 of the retention ring 40 is contained inside the axial projection of the outer contour of the finishing cord 13, the outer contour of the upper step 43 being substantially greater than the inner contour of the finishing cord 13, in order that the latter may function as a retention stop against upward displacement of the retention ring 40.

The subject closure device may further comprise a suspension handle 70 having opposite ends 71 articulated in opposite regions of the retention ring 40. It should be understood that the suspension ring 70 may have the opposite ends thereof incorporated to the retention ring 40 by means of elastically deformable connecting portions able to operate as an articulation between the suspension handle and the retention ring.

The suspension handle 70 is dimensioned in order to be displaced between an inoperative position, laterally involving part of the perimeter of the upper end portion 11 of the tubular body 10, and an operative position, positioned above the container, to allow a user to grip and manually transport the container.

By means of the proposed construction, the suspension handle 70 remains coupled to the retention ring 40 which, in turn, remains solidly retained around the upper end portion 11 of the tubular body 10, between the finishing cord 10 and the peripheral rib 14.

In the illustrated embodiment, each opposite end region of the retention ring 40 externally incorporates a bearing 41, it being understood that, in the illustrated embodiment, the suspension ring 70 incorporates, on each end 71, a pin 72, located radially facing inwards and rotatably retained inside a respective bearing 41 of the retention ring 40.

Further, according to the drawings, the suspension handle 70 is contained within the axial projection of the outer contour of the peripheral rib 14 of the tubular body 10, in order to have at least its median portion supported by said peripheral rib 14 when in the inoperative position.

The closure device may further comprise a seal means 60 which is fixed, in a breakable manner, to at least one of the parts of retention ring 40 and outer skirt 53, and which cooperates with the other part to prevent the elastic deformation of the outer skirt 53, until the operation of first opening of the lid 20 is effected.

Preferably, the seal means 60 comprises a lower portion 61 joined in a single piece to the retention ring 40, by means of a breakable region 61*a*, and an upper portion 62, in the form of a belt, which is positioned around the outer skirt 53 of the locking ring 50 and seated against said outer skirt 53, preventing the unlocking elastic deformation thereof in relation to the retention ring 40.

In the illustrated embodiment, the locking ring 50 and the suspension handle 70 are built as separate parts of the retention ring 40, which incorporates the seal means 60.

However, it should be understood that the locking ring 50 may also be connected in a single piece to the retention ring 40 by one or more bridges or breakable weakened regions, working as a seal means to make evident the first opening operation of the container or violation of the contents thereof. In such case, the retention ring 40, the locking ring 50 and the seal means 60 are formed in a single piece of plastic material.

While only one embodiment of the present closure device has been illustrated herein, it should be understood that alterations can be made in the form and disposition of the elements, without departing from the constructive concept defined in the claims that accompany the present disclosure.

The invention claimed is:

1. A closure device for a metallic container having a tubular body having an upper end portion which incorporates an outer and upper finishing cord, an outer and lower peripheral rib, and a retention ring seated around the tubular body and axially locked between the finishing cord and the peripheral rib, the closure device comprising:

a lid including a peripheral upper skirt to be fitted inside said upper end portion and externally incorporating an end cord defining an outer curl; and a locking ring having an upper portion seated onto the end cord of the lid, and incorporating, in a single piece, an inner skirt radially seated against the interior of said peripheral upper skirt of the lid and an outer skirt, radially and externally seated against said end cord and finishing cord and incorporating an inner circumferential rib which surrounds, inferiorly, said end cord and which is seated onto the finishing cord, the outer skirt being elastically deformable, from a locked position on the retention ring against upward displacement, to an position unlocked from said retention ring.

2. The closure device, as set forth in claim 1, wherein the upper end portion of the tubular body comprises a cylindrical inner surface, the peripheral upper skirt of the lid is being provided with a circumferential rib facing outwards and housing an elastic sealing ring to be pressed against the cylindrical inner surface of the tubular body when the lid is closed, said peripheral upper skirt maintaining a radial spacing in relation to the cylindrical inner surface.

3. The closure device, as set forth in claim 1, wherein the outer skirt of the locking ring is provided with a lower end face, inclined upwardly and radially inwardly, and at least one inner tooth, adjacent to the lower end face and to be fitted and upwardly locked under an upper step of the retention ring externally provided with and defining a circumferential recess.

4. The closure device, as set forth in claim 3, wherein the upper step of the retention ring is contained within the axial projection of the outer contour of the finishing cord.

5. The closure device, as set forth in claim 1, further comprising a suspension handle having opposite ends articulated at opposite regions of the retention ring and being displaceable between an inoperative position, laterally involving part of the perimeter of the upper end portion of the tubular body, and an operative position, positioned above the container.

6. The closure device, as set forth in claim 5, wherein each opposite end region of the retention ring externally incorporates a bearing, the handle incorporating, on each end, a pin positioned radially facing inwards and rotatably retained inside a respective bearing of the retention ring.

7. The closure device, as set forth in claim 6, wherein the suspension handle is contained within the axial projection of the outer contour of the peripheral rib of the tubular body.

8. The closure device, as set forth in claim 1, further comprising a seal means which is fixed, in a breakable manner, to at least one of the parts of retention ring and outer skirt and which cooperates with the other part, in order to prevent the elastic deformation of the outer skirt.

9. The closure device, as set forth in claim 8, wherein the seal means comprises a lower portion which is joined, in a single piece, to the retention ring by at least one breakable region, and an upper portion, in the form of a belt, positioned around the outer skirt of the locking ring and seated against the first, preventing the unlocking elastic deformation thereof in relation to the retention ring.

10. The closure device, as set forth in claim 1, wherein the outer contour of the locking ring is contained within the axial projection of the outer contour of the peripheral rib of the tubular body.

* * * * *